US006971894B2

(12) United States Patent
Dillon et al.

(10) Patent No.: US 6,971,894 B2
(45) Date of Patent: Dec. 6, 2005

(54) DUAL ACTION MECHANICAL ASSISTED CONNECTOR

(75) Inventors: Christopher J. Dillon, Farmington Hills, MI (US); Ping Chen, Farmington Hills, MI (US)

(73) Assignee: JST Corporation, Farmington Hills, MI (US)

( * ) Notice: Subject to any disclaimer, the term of this patent is extended or adjusted under 35 U.S.C. 154(b) by 0 days.

(21) Appl. No.: 10/812,927

(22) Filed: Mar. 31, 2004

(65) Prior Publication Data

US 2005/0221647 A1 Oct. 6, 2005

(51) Int. Cl.[7] ..... H01R 13/62
(52) U.S. Cl. ..... 439/157; 439/347; 439/372
(58) Field of Search ..... 439/157, 347, 439/372

(56) References Cited

U.S. PATENT DOCUMENTS

| | | | | |
|---|---|---|---|---|
| 3,392,245 | A | 7/1968 | Asick | |
| 3,478,301 | A | 11/1969 | Conrad et al. | |
| 3,488,623 | A | 1/1970 | Stephenson et al. | |
| 4,075,444 | A | 2/1978 | Hollingsead et al. | |
| 4,236,190 | A | 11/1980 | Hollingsead et al. | |
| 4,332,432 | A | 6/1982 | Colleran | |
| 4,586,771 | A | 5/1986 | Kraemer et al. | |
| 4,684,194 | A | 8/1987 | Jenkins et al. | |
| 5,252,089 | A | 10/1993 | Hatagishi et al. | |
| 5,681,175 | A | 10/1997 | Busse et al. | |
| 5,775,957 | A | 7/1998 | Fink et al. | |
| 5,810,612 | A | 9/1998 | Flask et al. | |
| 5,873,745 | A | 2/1999 | Duclos et al. | |
| 5,938,458 | A | 8/1999 | Krehbiel et al. | |
| 5,967,809 | A | 10/1999 | Fink et al. | |
| 6,113,407 | A | 9/2000 | Martin | |
| 6,142,826 | A | 11/2000 | Bourillon | |
| 6,168,445 | B1 * | 1/2001 | Seutschniker et al. | 439/157 |
| 6,213,795 | B1 * | 4/2001 | Drescher et al. | 439/157 |
| 6,217,354 | B1 | 4/2001 | Fencl et al. | |
| 6,270,376 | B1 * | 8/2001 | Fink et al. | 439/595 |
| 6,305,957 | B1 * | 10/2001 | Fink et al. | 439/157 |
| 6,312,272 | B1 | 11/2001 | Gaupp et al. | |
| 6,325,648 | B1 | 12/2001 | Bilezikjian et al. | |
| 6,345,995 | B1 * | 2/2002 | Bigotto et al. | 439/157 |
| 6,361,337 | B2 | 3/2002 | Kurimoto | |
| 6,471,527 | B2 | 10/2002 | Fukamachi et al. | |
| 6,488,516 | B2 | 12/2002 | Osawa et al. | |
| 6,551,118 | B2 | 4/2003 | Langolf et al. | |
| 6,558,176 | B1 | 5/2003 | Martin et al. | |
| 6,565,372 | B2 | 5/2003 | Bakker et al. | |
| 6,638,085 | B1 | 10/2003 | Martin | |
| 6,641,423 | B1 * | 11/2003 | Giro | 439/347 |
| 6,644,991 | B2 | 11/2003 | Martin | |
| 6,652,298 | B2 * | 11/2003 | Ohnuki | 439/157 |
| 6,824,406 | B1 * | 11/2004 | Sharples et al. | 439/157 |

* cited by examiner

*Primary Examiner*—Ross Gushi
(74) *Attorney, Agent, or Firm*—Nixon Peabody LLP

(57) ABSTRACT

A lever-type electrical connector assembly reduces the connection mating forces required to mate female and male connectors. The connector assembly employs a first connector with cam follower projections, a base housing with guide channels, a slide cam housing including cam grooves and projection guide tracks, and a cover housing pivotally mounted on the base housing, the cover housing having a cover housing projection. As the cover housing is rotated from an open to a closed position, it engages the cover housing projection in the projection guide track. This engagement moves the slide cam housing in the guide channel. As the slide cam housing is moved from an open to a closed position, it engages the cam follower projections in the cam grooves thereby drawing the first connector into the base housing to a connected position.

25 Claims, 8 Drawing Sheets

DUAL ACTION MECHANICAL ASSISTED CONNECTOR

FIELD OF THE INVENTION

The invention relates generally to electrical connector assemblies. More particularly, the invention relates to an electrical connector assembly with a lever mechanism to securely mate and un-mate the connectors with a reduced mating force as a cover housing is rotated.

BACKGROUND OF THE INVENTION

Electrical connector assemblies used in automotive and other applications often employ a large number of terminals and therefore require a large mating force to ensure a secure connection between the male and female connectors. Significant frictional forces from the terminals and housings must be overcome to properly join the connectors. However, assembly specifications for these connector assemblies include maximum mating force limits to prevent damage to the connectors or terminals during mating and to insure that an operator can easily and reliably mate the two connectors. These opposing constraints must both be satisfied for a connector assembly to function properly.

Conventional electrical connectors have employed levers, cams, slides, and a variety of mechanical devices to assist operators in joining those connectors that contain a large number of terminals and therefore provide significant frictional resistance. One approach used to overcome high mating forces is to employ a lever as a mechanical assist device with which to join the connectors. Lever-type devices rely on an increased moment to overcome frictional forces by applying a mating force at a distance from the fulcrum. Similarly, the use of cam systems rely upon a similar transfer of forces over distances by transferring non-linear motion into linear movement and as such, a greater linear distance between two connectors may be spanned by moving the cam over a relatively smaller non-linear distance. Connectors are drawn together to a mated position by moving the cam and engaging a cam follower.

While these methods of converting smaller applied forces into larger mating forces have been employed in the past, problems occur when the connectors are not properly aligned prior to applying the mating force, or when the connectors become misaligned as the mating force is applied. This can result from improper initial alignment of the connectors, as well as misalignment due to a fluctuating or inconsistent applied force. Prior attempts to overcome these challenges have fallen short in suitably addressing both concerns simultaneously. That is, there is a lack of a suitable connector that may apply an appropriately large and uniform mating force while ensuring the connection is properly made along the mating axis without either connector becoming misaligned.

For example, U.S. Pat. No. 6,217,354 appears to disclose an electrical connector with an actuating lever that is pivotally mounted to one side of the connector assembly. The actuating lever includes a cam groove. Additionally, a slide member is mounted on the actuating lever and moves linearly as the actuating lever pivots. The slide member includes a cam follower projection that engages in the cam groove of the actuating lever. The slide member also has a second cam groove. The second side of the connector assembly has a second cam follower projection that engages in the second cam groove of the slide member. As the actuating lever pivots, the slide member moves linearly relative to both sides of the connector as the cam follower projections engage the cam grooves, and the connector sides mate and un-mate in response to the lever action. However, the '354 patent fails to disclose means with which to suitably align the entire connector assembly during the mating action while simultaneously guarding against actuation of the cam mechanism when the connector is not properly mated.

Additionally, U.S. Pat. No. 5,938,458 appears to disclose an electrical connector assembly with an actuating lever pivotally mounted to a first connector. The actuating lever has a cam groove formed therein. A second connector has a cam follower projection to engage in the cam groove of the actuating lever. The connectors are mated and un-mated in response to the rotation of an actuating lever. The '458 patent, however, fails to disclose means with which to suitably align the connectors prior to engaging the cam system as well as to overcome higher mating forces required by multi-pin and multipart connectors.

U.S. Pat. No. 5,681,175 is another example of an electrical connector that appears to employ a camming system for mating and unmating a pair of electrical connectors. The '175 patent discloses a lock slide member mounted on one of the housings and movable along a path transverse to the mating axis. The lock slide member includes one cam track, while the other housing has a cam follower projection. As the lock slide member is moved, the cam follower projection projects into the cam track, and the connectors are mated. While the '175 patent employs a camming system, it fails to disclose means with which to suitably align the connectors during the mating process, and further fails to disclose a mechanism to overcome higher mating forces required in multi-pin and multipart connector applications. The slide mechanism of the '175 patent produces a significantly smaller mechanical advantage which may result in an inadequate applied mating force for multi-pin connectors.

None of the previous electrical connector assemblies adequately generate the large mating force required to join male and female multi-pin connector structures while properly aligning the connectors to avoid skewing while they are mated.

What is needed is a new type of electrical connector assembly that provides suitably large mating forces that are substantially constant during the mating process while providing a guided system where the connectors may not be misaligned prior or during the mating process.

SUMMARY OF THE INVENTION

The present invention relates to an electrical connector assembly and method for establishing and maintaining electrical contact between conductive members to be joined by employing a lever mechanism and cam system to securely mate and un-mate the connectors with a reduced mating force as a cover housing is rotated.

The present invention provides a simple, powerful, and inexpensive electrical connector assembly to securely and confidently join male and female electrical connector structures to ensure electrical continuity and complete electrical circuits.

The task of securely and reliably joining multi-pin electrical connectors presents a difficult challenge as the number of pins increases and the corresponding required mating forces likewise increase. With large forces necessary, an alignment error of the male and female structures may result in inordinately high stress on the individual pins resulting in cracked conductors or damaged insulators, as well as pushed pins that fail to meet and join a corresponding receptacle.

These maladies then result in faulty or intermittent connections and greatly increase product costs as extensive troubleshooting may be required to detect the faulty assembly once the product is assembled.

No previous connector assembly employs a lever-type connector assembly with a slide cam housing employing cam groove-cam follower projections coupled with floating projection guides to ensure the mating forces are applied along the proper mating axis and are substantially constant during the mating process.

The present lever-type electrical connector assembly invention reduces required connecting mating forces by employing a connector structure that includes two cam follower projections. The housing assembly includes a base housing for receiving the connector structure. The base housing includes a pivot anchor and a guide channel for receiving legs of the slide cam housing. The slide cam housing includes a generally rectangular projection guide to accommodate a cover housing projection. The slide cam housing also has a pair of first and a pair of second cam grooves on the slide cam legs that receive first and second pairs of cam follower projections that are part of the connector. The cover housing is pivotally mounted on the base housing.

The present invention eliminates alignment errors while simultaneously reducing the required mating forces by means of a lever assembly and camming system that provides a dual action mechanical assist to establish an intimate electrical connection between male and female connector structures. The present invention employs a novel projection guide geometry that results in mating forces that are substantially constant throughout the mating operation.

The method of the present invention allows users to securely and reliably mate connectors with large numbers of pins and high mating forces, while at the same time preventing alignment errors, eliminating intermittent connections, and improving reliability of the overall product.

BRIEF DESCRIPTION OF THE DRAWINGS

The above-mentioned and other features and objects of this invention and the manner of attaining them will become more apparent, and the invention itself will be better understood by reference to the following description of embodiments of the invention taken in conjunction with the accompanying figures where.

DETAILED DESCRIPTION OF THE INVENTION

The invention is described in detail with particular reference to certain preferred embodiments, but within the spirit and scope of the invention, it is not limited to such embodiments. It will be apparent to those of skill in the art that various features, variations, and modifications can be included or excluded, within the limits defined by the claims and the requirements of a particular use.

The present invention extends the functionality of current electrical connector assemblies by properly and consistently aligning multi-pin connectors and joining the structures with reduced mating forces. Once joined, the electrical connector assembly of the present invention is secured using the slide cam housing to ensure that the connection does not loosen or otherwise disconnect over time. This has many advantages over prior assemblies such as those providing simple cam slides, because the dual action mechanical assistance provided by the present invention significantly reduces the required mating forces while providing improved alignment consistency and reliability by way of the slide cam legs and the novel geometry of the pivot point.

Figure 1A:
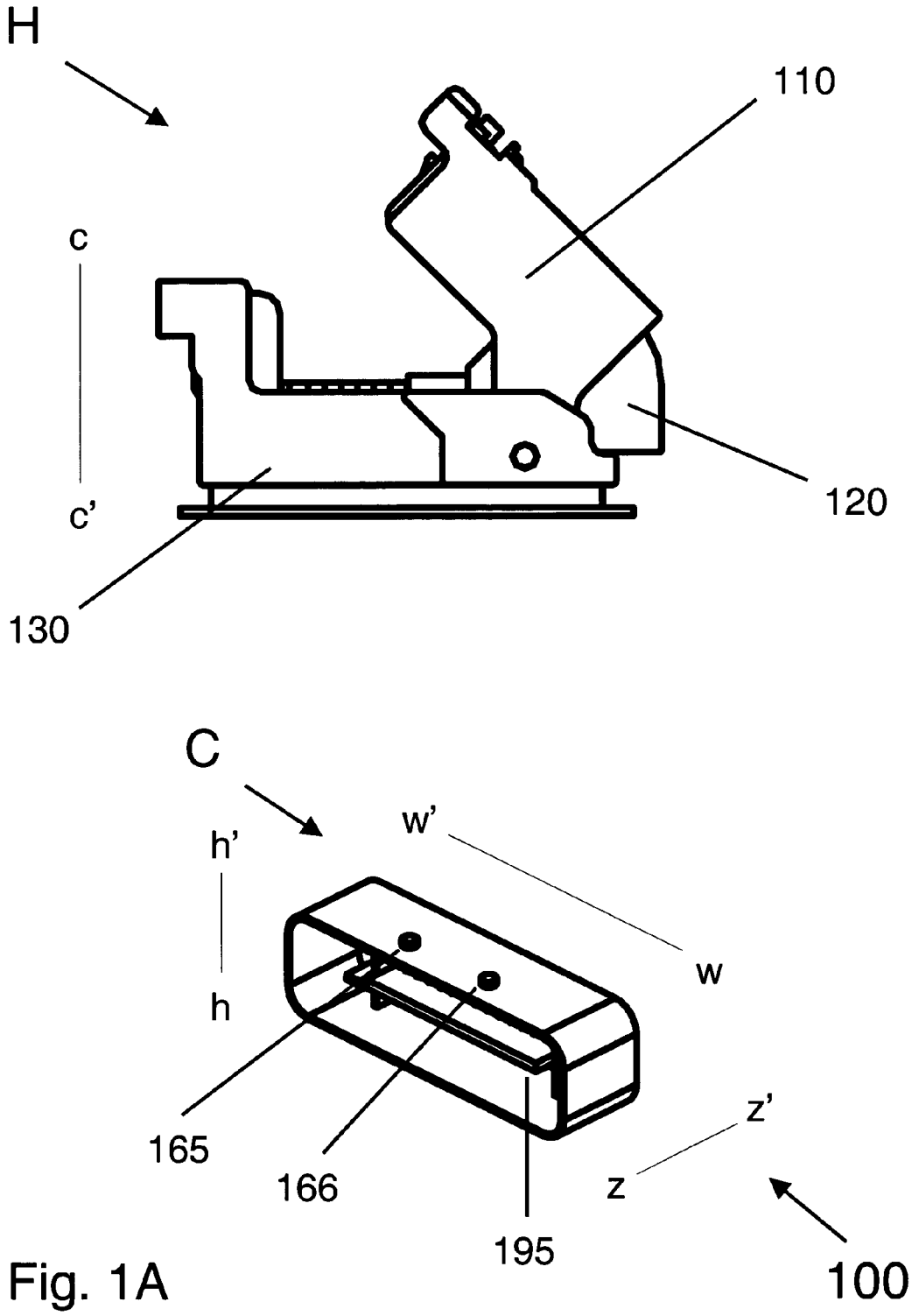
FIG. 1A is a perspective view of the connector assembly in accordance with the present invention shown in a fully unmated state.

FIG. 1A illustrates connector assembly 100 in a fully unmated state. It should be understood that in the following figures, housing H of the connector assembly 100 includes the dual action mechanical assist mechanism of the present invention, and that the individual male and female connector structures may be reversed between housing H and connector C without changing the overall structure of connector assembly 100 of the present invention. For brevity and convenience, reference will be made to housing H and connector C structures as depicted in FIG. 1A. The particular components of the housing H and connector C are illustrated in detail in FIGS. 1B–1E.

FIG. 1A shows housing H and connector C. In connector C, electrical contact points 195 are formed through in the front to rear direction of connector C as illustrated by directional line z–z'. The electrical contact points 195 are formed parallel to each other in several rows in the height direction of the connector C as illustrated by directional line h–h' and in several columns in the width direction of the connector C as illustrated by directional line w–w'. An electric wire W (not shown) is connected to each electrical contact point 195. In housing H, chambers 190 are formed in a reciprocal fashion to accommodate the type of electrical contact point 195 utilized in connector C. The electrical contact points 195 may be made in any number of ways, including, but not limited to blade terminals, pin terminals, block terminals, edge connectors, and the like, as long as the chambers 190 on housing H and electrical contact points 195 on connector C form the two halves of the physical junction that join to complete an electrical circuit. Connector C also includes first cam follower projection 165 and second cam follower projection 166. Similarly, two corresponding cam follower projections are present on the underside of connector C (not shown), along the h–h' axis so that there are a total of two pairs of cam follower projections on connector C.

Housing H is made of an insulating material and forms the reciprocal side of connector assembly 100 and comprises a base housing 130. Base housing 130, best illustrated in FIG. 1D, has a first guide channel 133 formed to accept a first slide cam leg 150. A corresponding second guide channel is formed on the opposite side of base housing 130. The two guide channels are mirror images of each other about the center of the width of base housing 130. Base housing 130 includes chambers 190 formed in a reciprocal arrangement to join electrical contact points 195 on connector C. Chambers 190 may be arranged in parallel rows and columns as shown in FIG. 1D, or in any fashion to accommodate the joining of electrical contact points 195 on connector C. A slide cam housing 120, as shown in FIG. 1C includes the first slide cam leg 150. A corresponding second slide cam leg is formed on the opposite side of slide cam housing 120. The two slide cam legs are mirror images of each other about the center of the width of slide cam housing 120. Each slide cam leg 150 includes a first cam groove 152, a second cam groove 154, and a projection guide track 122, each of which accept cover housing projections 112. The cover housing projections 112 are formed as part of cover housing 110, one such projection illustrated in FIG. 1B, with the second projection extending from the opposing side of cover housing 110. Cover housing 110 is pivotally mounted on the base housing 130 and forms a protective cover shielding the point of electrical contact between connector C and housing H in connector assembly 100 as does the back wall 126 of slide cam housing 120. Optionally, connector C and housing H may also be lined with a flexible impervious material to prevent liquid and vapor from reaching the electrical connection point of contact when assembled.

Figure 1B:
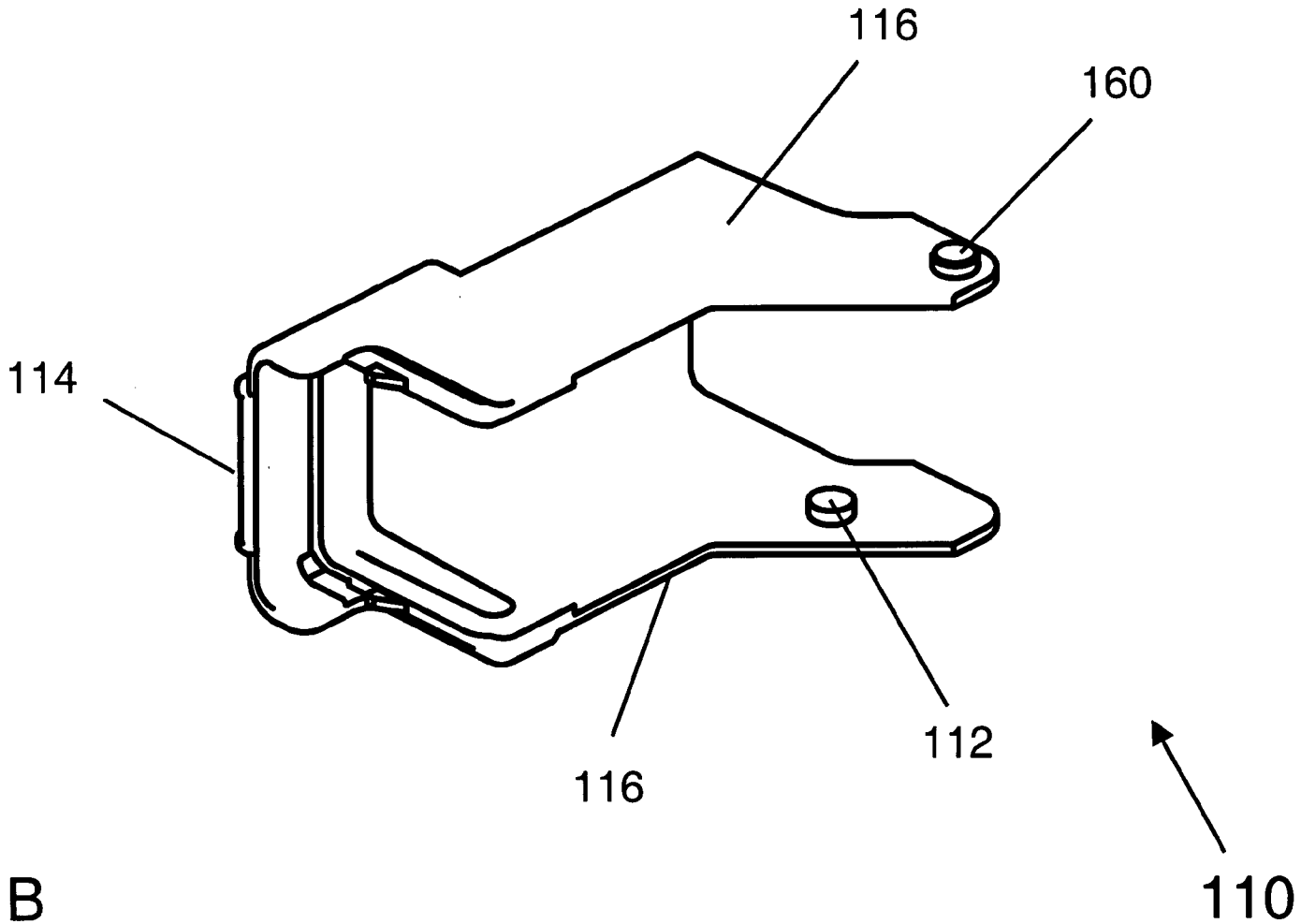
FIG. 1B is perspective view of the cover housing of the present invention.
Figure 1C:
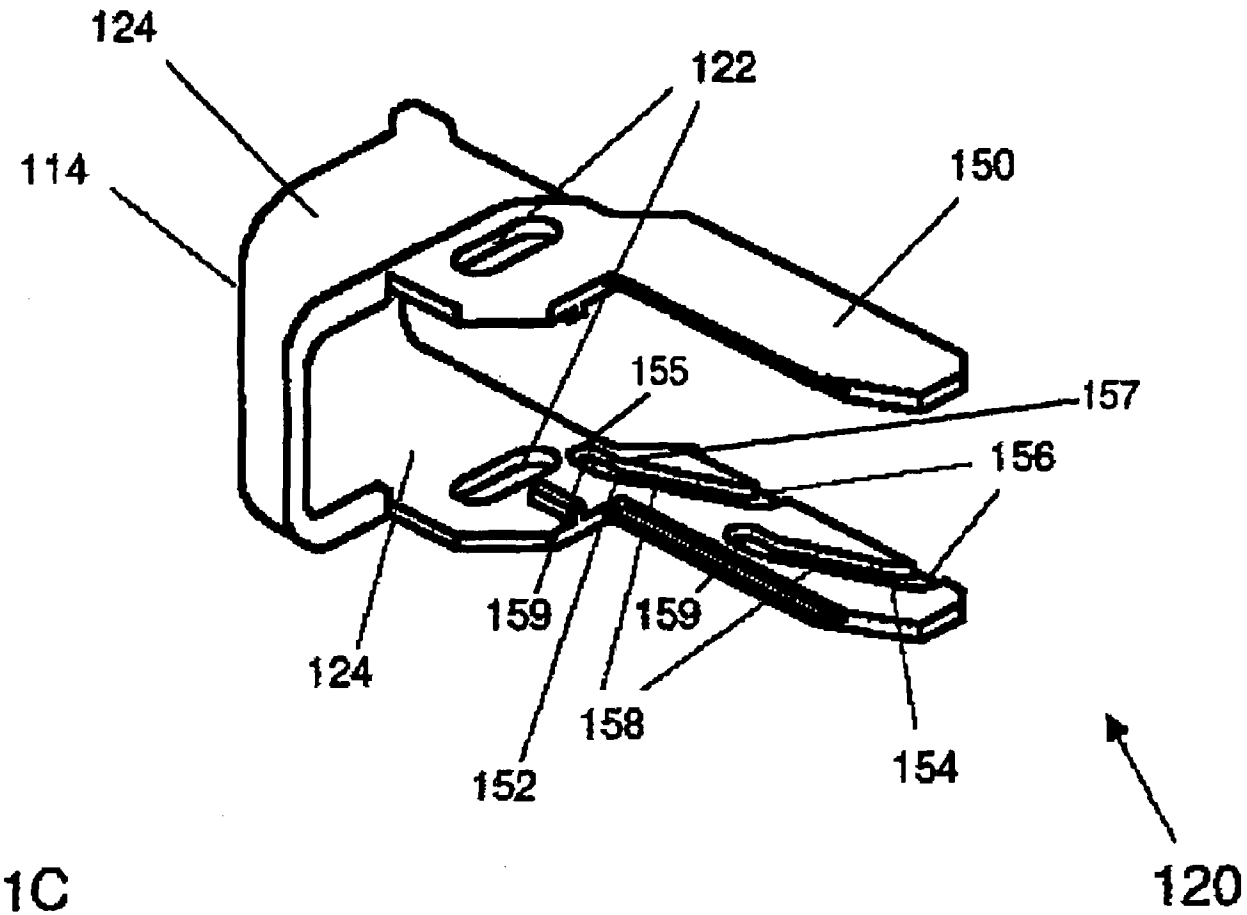
FIG. 1C is perspective view of the slide cam housing of the present invention.
Figure 1D:
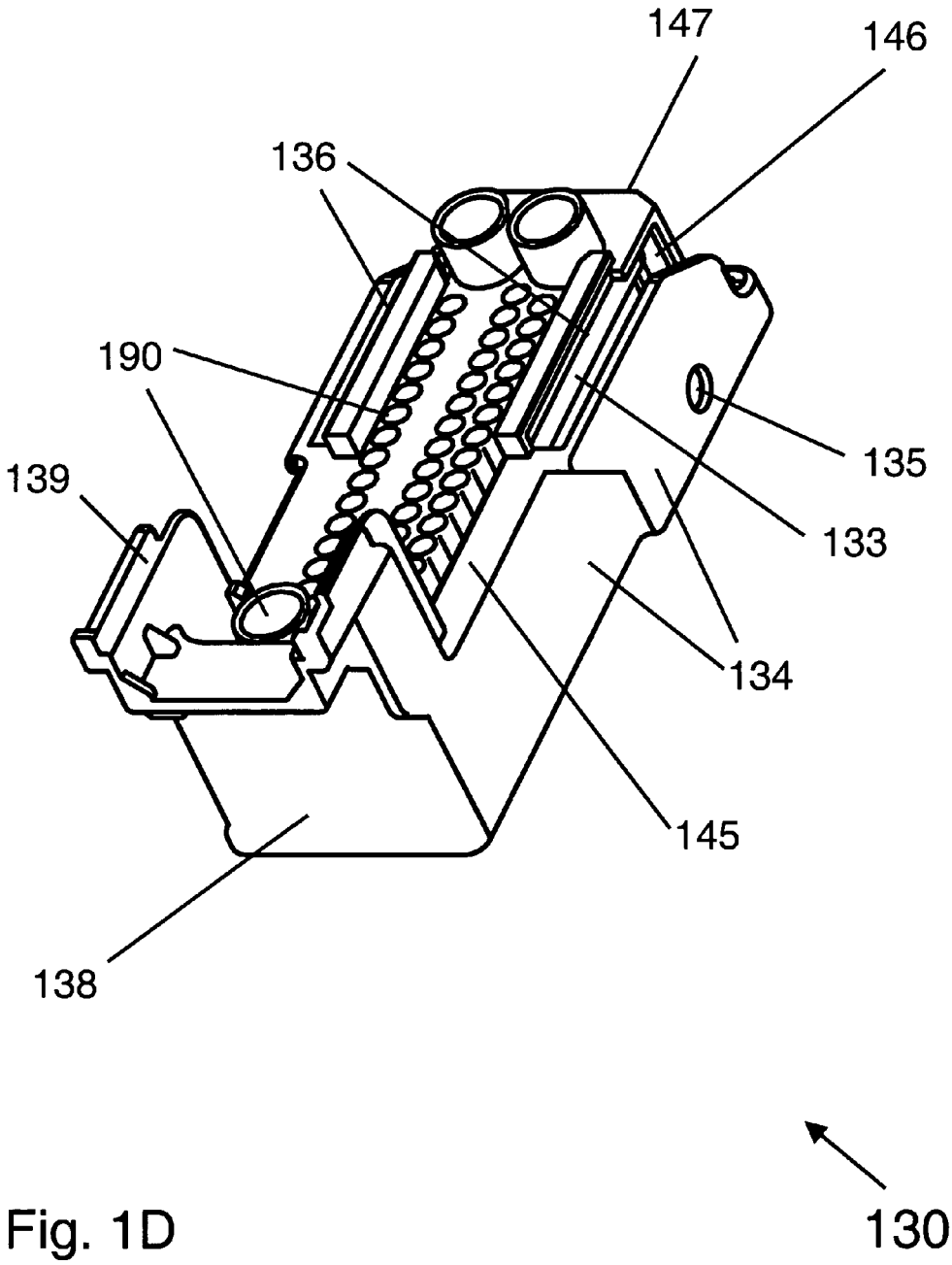
FIG. 1D is a perspective view of the base housing of the present invention.
Figure 1E:
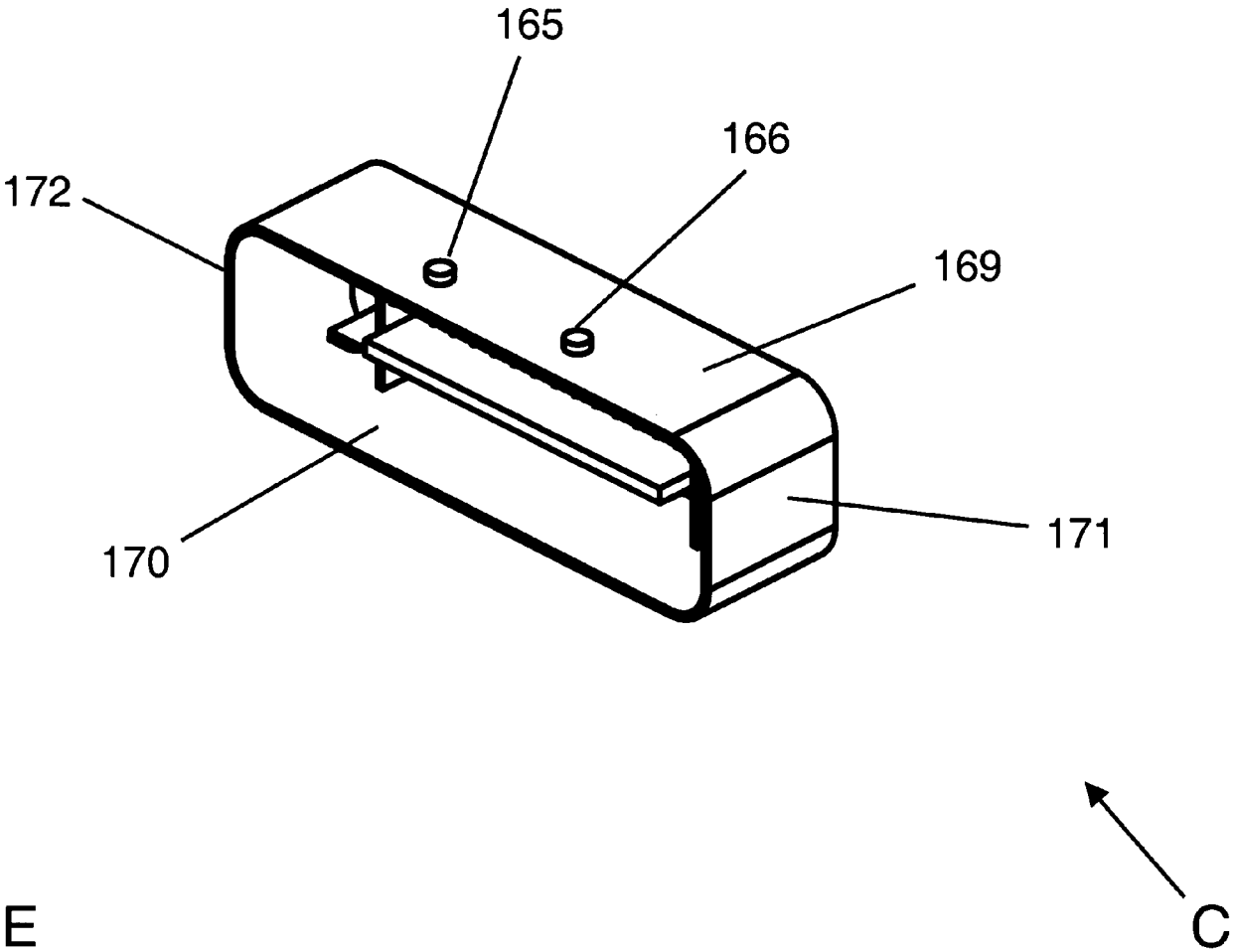
FIG. 1E is a perspective view of the mating connector of the present invention.

With reference now to the details of FIGS. 1B–1E, each of the four components which make up the connector assembly 100 are separately illustrated. As noted above, the components include connector C, with cover housing 110, slide cam housing 120, and base housing 130 combining to form housing H. As also mentioned hereinabove, the cover housing 110 forms a protective cover shielding the electrical connections made between the housing H and connector C as does the side walls 124 and the back wall 126 of slide cam housing 120. As shown in FIG. 1B, cover housing 110 is a three-sided housing having sidewalls 116 and a rear wall 114. The rear wall 114 and side walls 116 may optionally include ridges (not shown) which aid the user in engaging the cover housing 110 such that during operation of the cover housing 110, the finger or thumb of the user does not readily slip off the cover housing 110. Each of the sidewalls 116 includes one of the pivots 160 each being received in one of the pivot holes 135 of the base housing 130. Each of the sidewalls 116 further includes one of the projections 112 each being received in one of the projection guide tracks 122 of the slide cam housing 120.

As further shown in FIG. 1C, slide cam housing 120 similarly includes two side walls 124 and a back wall 126. The side walls 124 of the slide cam housing 120 are substantially planar with slide cam legs 150 extending from each of the side walls 124. The thickness of the sidewall 124 and of the slide cam legs 150 is such that both can be readily received by the base housing 130. As noted hereinabove, one side wall 124 includes first cam groove 152 and second cam groove 154 formed on an inside surface thereof while the opposing sidewall includes a corresponding second pair of cam grooves. The cam grooves 152 and 154 are identical images of one another and include lead-in portions 156, angled portions 158, and locking portions 159. the locking portions 159 may optionally include a detent portion at the end opposite the lead-in portion. The significance of the angled portions is explained in greater detail hereinbelow.

The base housing 130 includes guide channels 133 formed in each of the wing walls 134 on both sides of base housing 130. Guide channels 133 extend substantially parallel to and spaced from a respective sidewall 136 of the base housing 130. The configuration of the guide channels 133 includes an open section 146 and an enclosed section 145, the significance of which will be discussed in greater detail hereinbelow. The base housing 130 also includes end walls 137 and 138 with end wall 138 including a lead portion 139 for cooperating with the cover housing 110 in forming an opening to the housing H for receiving a lead wire, not shown.

An inner surface of each of the side walls 136 includes substantially parallel guide channels 133 for receiving the slide cam legs 150 of slide cam housing 120. Importantly, guide channels 133 accept slide cam legs 150 of slide cam housing 120 in both an open unmated position and in a closed mated position. The guide channels 133 are wider at the open sections 146 to accommodate the slide cam legs 150 of the slide cam housing 120 as well as the cover housing sidewalls 116 that extend to the pivots 160. The enclosed sections 145 of the guide channels 133 are narrower than the open sections 146 since only the slide cam legs 150 of the slide cam housing 120 are received in the enclosed section 145 of the guide channels 133. The guide channels 133 extend along the width of base housing 130 and aid in the proper alignment of the connector C with respect to the base housing 130.

Figures 4A, 4B, 4C:
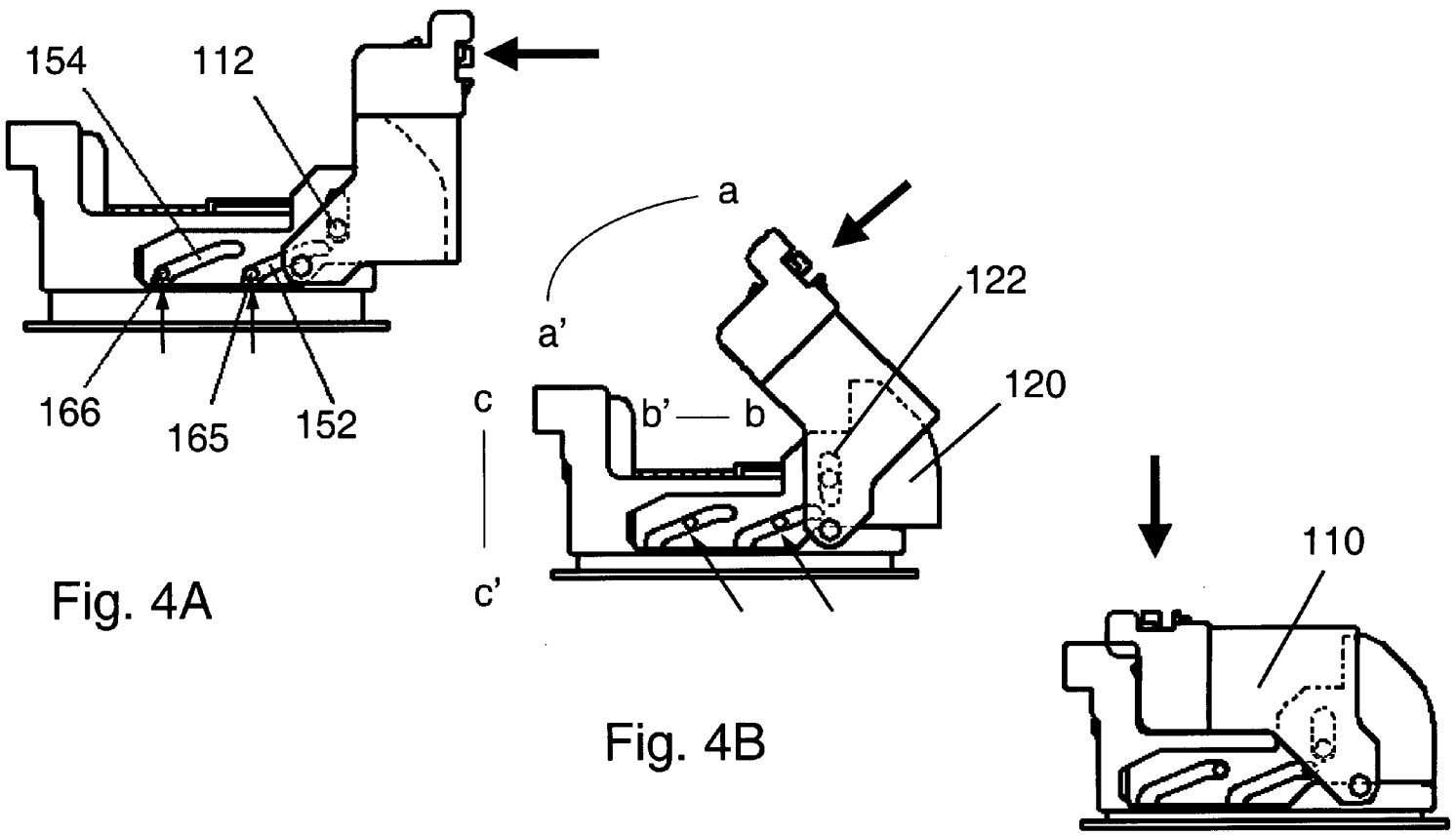
FIG. 4A is a perspective view of the connector assembly just prior to rotation of the cover housing.
FIG. 4B is a perspective view depicting the connector assembly as the cover housing is in the process of being rotated.
FIG. 4C is a perspective view showing the cover housing fully rotated and the connector assembly in its fully mated state.

The connector C includes side walls 169 and 170 and end walls 171 and 172 with the projections 165 and 166 extending from a substantially center region of each of the side walls 169 and 170, the connector C being sized to be slidingly received within the base housing 130 as shown in FIG. 4A. The projections 165 and 166 extending outwardly a distance less than the thickness of side walls 136 of the base housing 130 so as to extend into the space formed between the sidewalls 136 and wing walls 134 of the base housing 130. This is so that the cam follower projections 165 and 166 can be received by the first and second cam grooves 152 and 154 of the slide cam housing 120. This interaction will be described in greater detail hereinbelow.

Figure 2A:
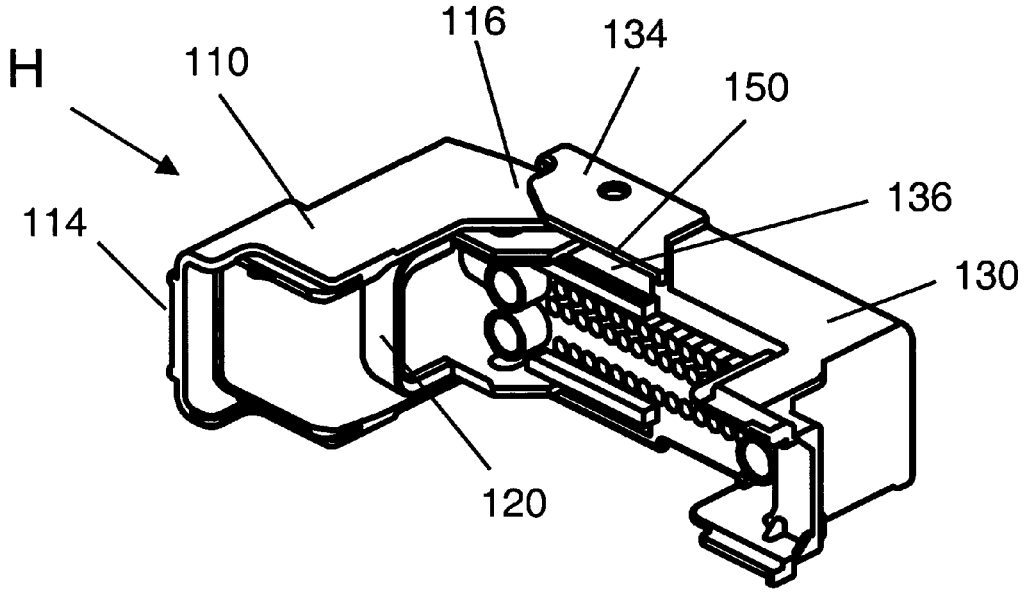
FIG. 2A is a perspective view of the connector housing just prior to beginning the mating process.

FIG. 2A illustrates connector assembly 100 in a fully unmated state. That is, connector C is not inserted in housing H. FIG. 2A shows housing H as it is activated to begin the mating process. For simplicity, and to better illustrate the operation of housing H, connector C is not shown in FIGS. 2A and 2B, but it should be understood that connector C is partially inserted in housing H prior to the method of practicing the present invention of mating the two structures of connector assembly 100. This arrangement is discussed below with respect to FIGS. 4A, 4B, and 4C.

Figure 2B:
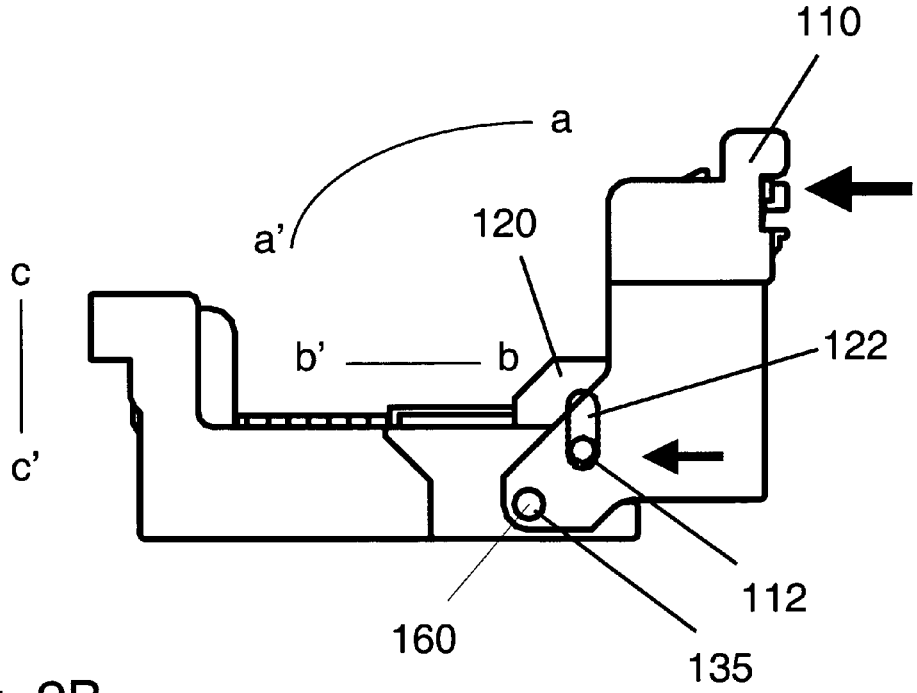
FIG. 2B is a perspective view of the connector housing showing the applied forces of the cover housing and the slide cam housing as the cover housing is rotated toward a mated state.

The initial operation of the present invention is further illustrated in FIGS. 2A and 2B. FIG. 2A illustrates the housing H in a fully open state, where the housing H is initially assembled, the slide cam housing 120 is received within the side walls 116 and in front of the rear wall 114 of cover housing 110 and further within the wing walls 134 of base housing 130. The pivots 160 of cover housing 110 are received in the pivot holes 135 of base housing 130, and the side walls 124 of slide cam housing 120 are received in the space formed between the wing walls 134 and the sidewalls 136 of base housing 130 which makes up guide channels 133. Further, the respective slide cam legs 150 of the slide cam housing 120 are received in the corresponding guide channels 133 formed in the wing walls 134 of base housing 130. The cover housing 110 and the base housing 130 are hingedly connected to one another such that the pivots 160 of cover housing 110 are securely disposed in pivot holes 135 of base housing 130. As best illustrated in FIG. 2A, slide cam legs 150 of slide cam housing 120 are sandwiched between base housing side walls 136 and cover housing sidewalls 116. Base housing wing walls 134 further form the outermost wall of the connector assembly 100.

FIG. 2B shows housing H as cover housing 110 fully-opened to begin the mating process. Cover housing 110 is pivotally mounted on base housing 130 utilizing pivots 160 in cover housing 110 and pivot holes 135 in base housing 130. Slide cam legs 150 of slide cam housing 120 are interposed adjacent to side walls 116 of cover housing 110. Both the slide cam legs 150 and the side walls 116 of cover housing 110 are sandwiched between the side walls 136 of base housing 130 and wing walls 134 of base housing 130.

Cover housing 110 is set to its fully-open state in the base housing 130 and will rotate along directional arc a–a' during mating. As cover housing 110 is rotated, projections 112 exert pressure on projection guide tracks 122 with force components generally in the width direction of the housing and in the front-to-rear direction of the housing H. The width direction is shown in FIG. 2B as directional line b–b' and the front-to-rear direction is shown in FIG. 2B as directional line c–c'. The corresponding force arrows in the appropriate directions are also shown.

The pressure exerted by projection 112 on projection guide tracks 122 causes slide cam housing 120 to move linearly in the width direction along line b–b'. As cover housing 110 is rotated to a fully closed mated position, projection 112 continues to force slide cam housing 120 to move linearly along direction line b–b' until cover housing 110 encounters a mechanical stop, which is lead portion 139 of base housing 130. Cover housing 110 encounters this mechanical stop corresponding to the end of the full range of angular motion of cover housing 110. Cover housing 110 and lead portion 139 of base housing 130 meet to form a protective cover, as will slide cam housing 120, for cable and wires leading to chambers 190 of base housing 130. At this point, cover housing 110 is in its fully closed position corresponding to the end of travel along arc a–a', and slide cam housing 120 is at the end of linear travel along direction line b–b'.

Figure 3:
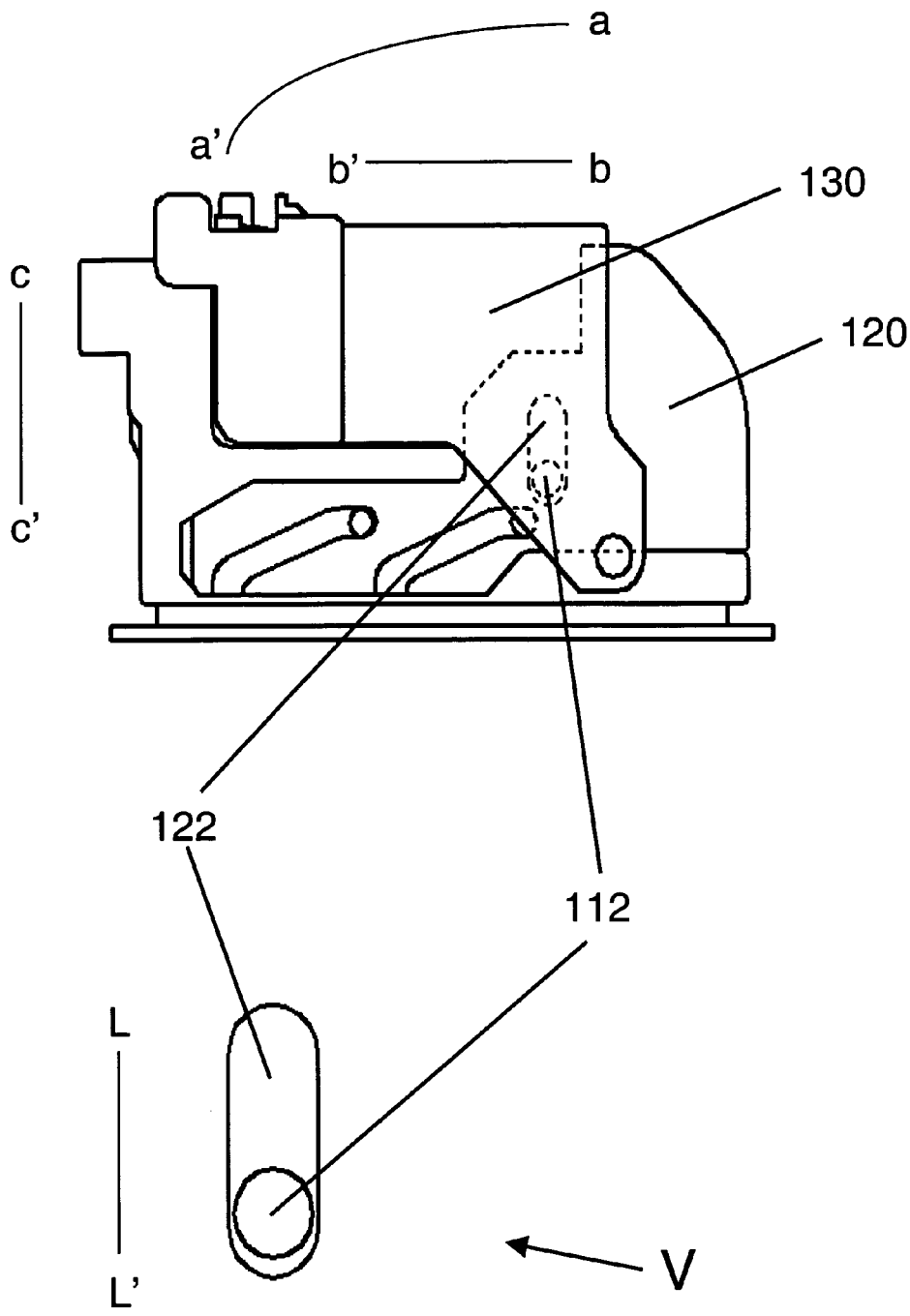
FIG. 3 is a perspective view of the connector housing showing the cover housing in a fully closed position.

Referring now to FIG. 3, once cover housing 110 has been rotated to its fully closed position, projection 112 has traveled in substantially the same parallel to arc a–a'. During this range of motion, projection 112 continued to force slide cam housing 120 to travel in a linear direction as projection 112 exerted pressure on projection guide tracks 122. Once cover housing 110 reaches the end of travel along arc a–a', slide cam housing 120 has traveled the full range of linear motion along direction line b–b' as well.

An enlargement of projection 150 in this position is shown in expanded view V. The shape of projection 112 is substantially a circle, while the shape of projection guide tracks 122 is substantially a rounded rectangle. The length of the projection guide tracks 122 L–L' is longer than the diameter D of projection 112. As such, projection 112 is able to move within the bounds of the walls of projection guide tracks 122 as cover housing 110 is rotated along arc a–a' from an open unmated position to a closed mated position. With projection 112 enjoying freedom to move within the projection guide tracks 122, the mating force in the c–c' direction peaks as cover housing 110 is closed along arc a–a' as slide cam housing 120 moves linearly in the b–b' direction.

Referring now to FIGS. 4A, 4B, and 4C, at the same time cover housing 110 is rotated and projection 112 forces slide cam housing 120 to move linearly in the b–b' direction by exerting pressure on projection guide tracks 122, first cam groove 152 on slide cam housing 120 engages first cam follower projections 165 on connector C and second cam groove 154 engages second cam follower projections 166 on connector C. In the illustrated embodiment shown in detail in FIG. 1C, first cam groove 152 and second cam groove 154 are angled with lead-in portions 156 to accept first cam follower projections 165 and second cam follower projections 166. First cam groove 152 and second cam groove 154 also have angled portions 158. Optionally, at the lateral stop end 155 opposite lead-in portions 156, a detent portion 157 may also be included in the cam grooves to provide an additional means with which to secure the connector assembly in a mated position. In the illustrated embodiment in FIG. 4B, a force in the c–c' mating direction is provided as cover housing 110 is rotated.

As cover housing 110 is rotated, slide cam housing 120 moves linearly along b–b'. As slide cam housing 120 moves linearly, first cam grooves 152 engage first cam follower projections 165, and second cam grooves 154 engage second cam follower projections 166. This action drives first cam follower projection 165 and second cam follower projections 166 in the c–c' direction. The projections 112 move freely in projection guide tracks 122 permit a substantially constant mating force to be applied in the c–c' direction. Coupled with the angular camming action of the cam grooves, connector C and housing H are drawn together into a mated condition by exerting a substantially constant force in the c–c' direction. This substantially constant force, along with the cam grooves 152, 154 and cam follower projections 165, 166 facilitates proper alignment of connector C and housing H as the structures are mated. Other, non-floating projection and projection guide track geometries may result in differential forces, which are much more likely to skew the connector C or the housing H and result in a faulty connection or a damaged connector assembly. While the floating projection—projection guide track assembly provides substantially constant force in the c–c' mating direction, the mating force is optimized with the largest c–c' force component when projections 112 are components of cover housing 110 and projection guide tracks 122 are components of slide cam housing 120. Reversing these components will result in a proper constant force application, but the magnitude of the c–c' directional component may be compromised.

The rotational motion of the cover housing 110 causes linear motion of slide cam housing 120 and a resulting linear motion of the pairs of cam grooves 152, 154 engaging the cam follower projections 165, 166, thereby causing linear motion of connector C relative to housing H along the c–c' direction, resulting in a mated connector assembly.

In FIGS. 4A, 4B, and 4C, the housing H is shown in three positions as the cover housing 110 is rotated. In FIG. 4A, cover housing projection 112 is at its initial unmated position. Since cover housing 110 has not been rotated, cover housing projection 112 has not applied force to projection guide tracks 122, and thereby slide cam housing 120 has not yet moved linearly, nor have the cam grooves 152, 154 of slide cam housing 120 engaged the cam follower projections 165, 166. In FIG. 4B, cover housing 110 is in the process of being rotated along arc a–a', thereby forcing projection 112 to drive slide cam housing 120 in the b–b' direction by applying pressure on projection guide tracks 122. As cover housing 110 is rotated toward its closed mated position, projection 112 drives slide cam housing 120 in the b–b' direction. Also, first cam grooves 152 receive and engage first cam follower projections 165 and the second cam grooves 154 receive and engage second cam follower projections 166 on connector C. During this point, the angled portions 158 of cam grooves 152 and 154 are engaging cam follower projections 165 and 166 providing a force reduction. In FIG. 4C, cover housing 110 is fully rotated, and the connection is complete. As shown in FIG. 4C, when cover housing 110 is fully rotated, projection 112 has fully driven slide cam housing 120 to its full length of linear travel in the b–b' direction, and optional detents in the cam grooves may be employed as locking devices to hold the connector assembly in its final, secure position.

If an operator must un-mate the connector assembly, the process is reversed as cover housing 110 is rotated in the opposite direction toward its initial position along arc a'–a. This, in turn, drives projection 112 against projection guide tracks 122 and forces slide cam housing 120 to move linearly in the opposite direction along b'–b. Simultaneously, as cover housing 110 is further rotated, the rotation forces first cam follower projections 165 and second cam follower projections 166 back along first cam groove 152 and second cam groove 154, respectively with force components generally in the width direction b'–b of the housing and in the front-to-rear direction c–c' of the housing H. For reference, the width direction b–b' and the front-to-rear direction, c–c' are shown in FIG. 4B. This disengaging of the cam followers from the cam grooves allows connector C to withdraw from housing H. When cover housing 110 is rotated back to its starting position, projection 112 has driven cam slide housing 120 back to its initial position as well. At this point, cover housing 110 is once again in its fully open position and projection 112 and slide cam housing 120 have been returned to their initial ends of travel.

While the present invention have been described in connection with a number of exemplary embodiments and implementations, the present invention is not so limited but rather covers various modifications and equivalent arrangements, which fall within the purview of the appended claims.

What is claimed is:

1. A lever-type electrical connector assembly that reduces required connecting mating forces comprising:

a first connector including at least one cam follower projection;

a base housing for connecting to the first connector, the base housing including a guide channel;

a slide cam housing having substantially parallel interconnected slide cam legs, each including at least one cam groove and a projection guide track, the slide cam housing extending into the guide channel of the base housing; and a cover housing having a cover housing projection engaged in the projection guide track, the cover housing pivotally mounted on the base housing by a fixed pivot point, such that when the cover housing is rotated from an open position to a closed position, the slide cam housing moves laterally along the width of the connector assembly in the same direction as the rotation of the cover housing.

2. The lever-type electrical connector assembly of claim 1, wherein the guide channel includes a lateral stop at the end point of the cam groove to prevent further travel of the slide cam housing.

3. The lever-type electrical connector assembly of claim 1, wherein the at least one cam groove includes a detent portion at the end point of the cam groove to prevent further travel of the slide cam housing and to secure the connector assembly in a mated position.

4. The lever-type electrical connector assembly of claim 1, wherein the length of the projection guide track is greater than the diameter of the cover housing projection.

5. The lever-type electrical connector assembly of claim 4, wherein the projection guide track is linear thereby providing a substantially constant mating force as the cover housing is rotated from an unmated position to a mated position.

6. The lever-type electrical connector assembly of claim 1, wherein the assembly is sealed to prevent liquid and vapor penetration.

7. The lever-type electrical connector of claim 1 wherein the substantially parallel interconnected slide cam legs of the slide cam housing includes two opposing slide cam legs and the base housing includes two opposing guide channels such that a respective slide cam leg is received in a respective guide channel.

8. The lever-type electrical connector of claim 7 wherein there are at least two cam grooves formed in each of the slide cam legs of the slide cam, and the slide cam is a single-piece component.

9. The lever-type electrical connector assembly of claim 8, wherein the guide channel includes a lateral stop at the end point of the cam groove to prevent further travel of the slide cam housing.

10. The lever-type electrical connector assembly of claim 7, wherein the interconnected slide cam legs includes a back wall that protects chambers, terminals, and wires when the cover housing is rotated to a mated position.

11. The lever-type electrical connector assembly of claim 8, wherein the at least one cam groove includes a detent portion at the end point of the cam groove to prevent further travel of the slide cam housing and to secure the connector assembly in a mated position.

12. The lever-type electrical connector assembly of claim 8, wherein the length of the projection guide track is greater than the diameter of the cover housing projection.

13. The lever-type electrical connector assembly of claim 12, wherein the projection guide track is linear thereby providing a substantially constant mating force as the cover housing is rotated from an unmated position to a mated position.

14. The lever-type electrical connector assembly of claim 8, wherein the assembly is sealed to prevent liquid and vapor penetration.

15. A lever-type electrical connector assembly that reduces required connecting mating forces comprising:

a first connector including a first cam follower projection and a second cam follower projection;

a base housing for connecting to the first connector, the base housing including a guide channel;

a slide cam housing having substantially parallel interconnected slide cam legs, each including a first cam groove, a second cam groove, a projection guide track, the slide cam housing extending into the guide channel of the base housing; and a cover housing having a cover housing projection engaged in the projection guide track, the cover housing pivotally mounted on the base housing by a fixed pivot point, wherein the cover housing is rotated from an open position to a closed position thereby engaging the cover housing projection in the projection guide track to move the slide cam housing laterally along the width of the connector assembly in the same direction as the rotation of the cover housing from an open to a closed position thereby engaging the first cam follower projection in the first cam groove and further engaging the second cam follower projection in the second cam groove thereby drawing the first connector into the base housing to a connected position.

16. The lever-type electrical connector assembly of claim 15, wherein the guide channel includes a lateral stop at the end point of the cam groove to prevent further travel of the slide cam housing.

17. The lever-type electrical connector assembly of claim 15, wherein the first cam grooves and the second cam grooves include a detent portion at the end point of the cam groove to prevent further travel of the slide cam housing and to secure the connector assembly in a mated position.

18. The lever-type electrical connector assembly of claim 15, wherein the length of the projection guide tracks are greater than the diameter of the cover housing projection.

19. The lever-type electrical connector assembly of claim 18, wherein the projection guide tracks are linear thereby providing a substantially constant mating force as the cover housing is rotated from an unmated position to a mated position.

20. The lever-type electrical connector assembly of claim 15, wherein the assembly is sealed to prevent liquid and vapor penetration.

21. A method of locking a connection member into secure electrical engagement with a housing member, said method comprising:

inserting the connection member into a housing member, the connection member comprising a first cam follower projection and a second cam follower projection, and the housing member comprising:

a base housing, the base housing comprising a guide channel;

a slide cam housing having substantially parallel interconnected slide cam legs, each including a first cam groove, a second cam groove, and a projection guide track, the slide cam housing extending into the guide channel of the base housing; and a cover housing having a cover housing projection engaged in the projection guide track, the cover housing pivotally mounted on the base housing with a fixed pivot point, rotating the cover housing from an open position to a closed position thereby engaging the cover housing projection in the projection guide track; and sliding the slide cam housing laterally along the width of the connector assembly in the same direction as the rotation of the cover housing from an open position to a closed position thereby engaging the first cam follower projection in the first cam groove and further engaging the second cam follower in the second cam groove thereby drawing the connection member into the base housing to a connected position.

22. The method of locking a connection member into secure electrical engagement with a housing member of claim 21 wherein the step of sliding the slide cam housing from an open position to a closed position is complete upon sliding the slide cam housing until the slide cam housing reaches a lateral stop.

23. The method of locking a connection member into secure electrical engagement with a housing member of claim 21, wherein the length of the projection guide tracks are greater than the diameter of the cover housing projection.

24. The method of locking a connection member into secure electrical engagement with a housing member of claim 23, wherein the projection guide tracks are linear thereby providing a substantially constant mating force as the cover housing is rotated from an unmated position to a mated position.

25. The method of locking a connection member into secure electrical engagement with a housing member of claim 21, further comprising the step of sealing the connector and the housing to prevent liquid and vapor penetration.

* * * * *

UNITED STATES PATENT AND TRADEMARK OFFICE

CERTIFICATE OF CORRECTION

PATENT NO. : 6,971,894 B2
APPLICATION NO. : 10/812927
DATED : December 6, 2005
INVENTOR(S) : Dillon et al.

It is certified that error appears in the above-identified patent and that said Letters Patent is hereby corrected as shown below:

Replace FIG. 3 with the following corrected version of FIG. 3:

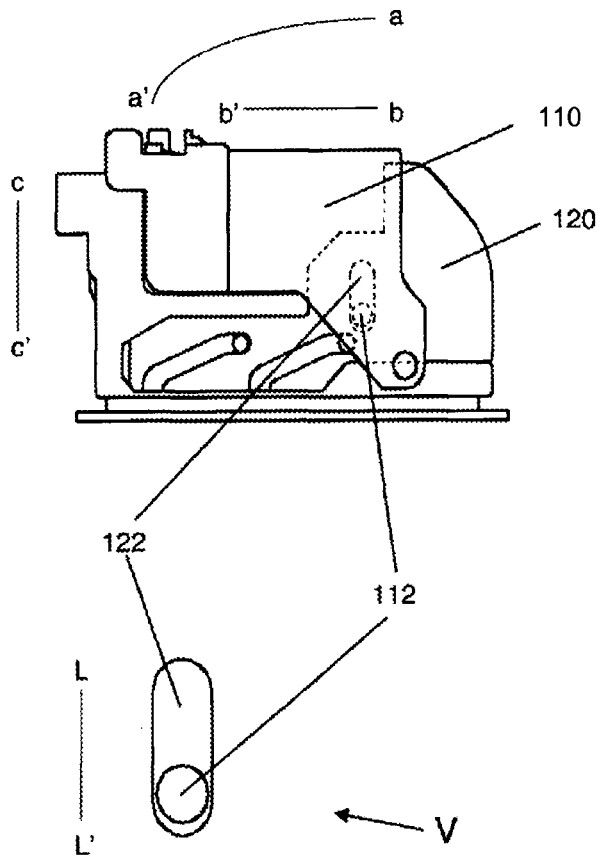

Fig. 3

Signed and Sealed this
Nineteenth Day of June, 2012

David J. Kappos

David J. Kappos
*Director of the United States Patent and Trademark Office*